US011713573B2

(12) United States Patent
Stonyer

(10) Patent No.: US 11,713,573 B2
(45) Date of Patent: Aug. 1, 2023

(54) SANDWICH PANEL AND BUILDING MODULE

(71) Applicant: Reve Architecture Limited, Wellington (NZ)

(72) Inventor: Michael David Stonyer, Wellington (NZ)

(73) Assignee: Reve Architecture Limited, Wellington (NZ)

( * ) Notice: Subject to any disclaimer, the term of this patent is extended or adjusted under 35 U.S.C. 154(b) by 177 days.

(21) Appl. No.: 16/948,685

(22) Filed: Sep. 29, 2020

(65) Prior Publication Data

US 2022/0018129 A1 Jan. 20, 2022

(30) Foreign Application Priority Data

Jul. 15, 2020 (NZ) ..... 766265

(51) Int. Cl.

| | |
|---|---|
| ***E04B 5/02*** | (2006.01) |
| ***E04B 1/14*** | (2006.01) |
| ***E04C 2/292*** | (2006.01) |
| ***E04C 2/32*** | (2006.01) |
| ***E04B 2/00*** | (2006.01) |
| ***E04B 7/22*** | (2006.01) |
| ***E04C 2/34*** | (2006.01) |
| ***E04B 1/348*** | (2006.01) |
| ***E04B 1/32*** | (2006.01) |

(52) U.S. Cl.

CPC ..... *E04C 2/50* (2013.01); *E04B 1/14* (2013.01); *E04B 1/3205* (2013.01); *E04B 1/34853* (2013.01); *E04B 5/02* (2013.01); *E04B 7/22* (2013.01); *E04C 2/292* (2013.01); *E04C 2/322* (2013.01); *E04C 2/3405* (2013.01); *E04C 2/46* (2013.01); *E04B 2001/3258* (2013.01); *E04B 2103/06* (2013.01); *E04C 2002/3444* (2013.01)

(58) Field of Classification Search

CPC ..... E04B 1/14; E04B 1/3205; E04B 1/34853; E04B 5/02; E04B 7/22; E04B 2001/3258; E04B 2103/06; E04C 2/50; E04C 2/292; E04C 2/322; E04C 2/3405; E04C 2/46; E04C 2002/3444

See application file for complete search history.

(56) References Cited

U.S. PATENT DOCUMENTS

| | | | | |
|---|---|---|---|---|
| 3,690,987 A * | 9/1972 | Curran et al. | ..... | B32B 7/14 156/292 |
| 3,807,105 A * | 4/1974 | Rudkin, Jr. | ..... | E04B 1/34815 52/80.1 |
| 4,073,105 A | 2/1978 | Daugherty | | |
| 4,937,125 A | 6/1990 | Sanmartin et al. | | |

(Continued)

FOREIGN PATENT DOCUMENTS

| | | | | |
|---|---|---|---|---|
| CA | 2099809 A1 | 1/1995 | | |
| CA | 2777635 A1 * | 4/2011 | ..... | E04C 2/292 |

(Continued)

*Primary Examiner* — Jessie T Fonseca

(74) *Attorney, Agent, or Firm* — McKee, Voorhees & Sease, PLC

(57) ABSTRACT

A building module which is a sandwich panel comprising a first region which provides part of the roof structure of a building, a second region which provides part of the wall structure of the building, and a third region which provides part of the floor structure of the building.

10 Claims, 8 Drawing Sheets

(56) References Cited

U.S. PATENT DOCUMENTS

| | | | | |
|---|---|---|---|---|
| 9,027,286 | B2 * | 5/2015 | Lane | E04D 3/365 52/90.2 |
| 2002/0020129 | A1 | 2/2002 | Winter | |
| 2008/0000176 | A1 * | 1/2008 | Mandelzys | E04F 13/0878 52/272 |
| 2013/0067838 | A1 | 3/2013 | Black et al. | |
| 2020/0130298 | A1 | 4/2020 | Lindeskov et al. | |
| 2021/0277648 | A1 * | 9/2021 | Dubov | E04B 1/12 |
| 2021/0277653 | A1 * | 9/2021 | Pospisil | E04B 5/10 |

FOREIGN PATENT DOCUMENTS

| | | | | |
|---|---|---|---|---|
| CA | 2937630 | A1 * | 1/2017 | B32B 13/06 |
| CN | 106988340 | B | 1/2019 | |
| EP | 3088628 | A1 * | 11/2016 | E04C 2/284 |
| FR | 2316402 | A1 | 1/1977 | |
| FR | 2509223 | A1 | 1/1983 | |
| KR | 20190025293 | A1 | 3/2019 | |
| NZ | 745100 | | 8/2018 | |
| WO | WO-9221516 | A1 * | 12/1992 | B29C 63/04 |
| WO | WO-0109454 | A1 * | 2/2001 | E04B 7/22 |
| WO | 2008133535 | A1 | 11/2008 | |
| WO | 2010036130 | A1 | 4/2010 | |
| WO | WO-2013167774 | A1 * | 11/2013 | E04B 5/02 |
| WO | WO-2016174614 | A1 * | 11/2016 | E04B 1/043 |
| WO | WO-2019039944 | A1 * | 2/2019 | E02D 5/22 |
| WO | WO-2019141678 | A1 * | 7/2019 | E04B 1/3205 |
| WO | 2019239435 | A1 | 12/2019 | |

* cited by examiner

SANDWICH PANEL AND BUILDING MODULE

CROSS-REFERENCE TO RELATED APPLICATION

This application claims priority under 35 U.S.C. § 119 to New Zealand Application No. 766265, filed on Jul. 15, 2020, which is herein incorporated by reference in its entirety including without limitation, the specification, claims, and abstract, as well as any figures, tables, or examples thereof.

This invention relates to a sandwich panel and a building module which can be joined together to construct a building.

BACKGROUND OF THE INVENTION

The construction industry in New Zealand faces a number of unique challenges in providing affordable housing. The field of building prefabrication attempts to address some of these challenges.

Prefabricated dwellings can be constructed in a factory and then transported to a site. This offers the advantage that weather and travel of construction professionals are not factors in the construction process. One downside is that the design of prefabricated dwellings is limited by the mode of transport and route to the construction site, in New Zealand predominantly by truck and possibly by rail. This introduces limitations of width and height of the load to be transported, with the limitation of length being defined by the vehicle. These limitations are usually addressed in one of two ways: by designing the dwelling to fit onto a single truck, known as a "tiny house" or by designing the building as modules to be fitted together on-site.

An advantage of a prefabricated dwelling design is that if the New Zealand Ministry of Building, Innovation and Employment (MBIE) approves the design, they will grant a multi-proof building consent on the design. This means a building consent application corresponding to the multi-proof consent documents must be approved by the Building Consent Authority without questions within 10 days.

Prefabricated dwelling designs made in a factory using conventional components, for example timber framed construction, are offered as factory-made dwellings and also as kit-sets for constructing on-site. Nookhomes.co.nz offer such transportable homes in both formats.

Factory-made dwellings using conventional timber-framed construction use a large number of components and are labour-intensive to assemble, whether on-site or in a factory. Transporting assembled dwellings introduces a number of additional challenges.

A sandwich panel or structural insulated panel (SIP) is a structure comprising three layers; a core of low-density insulating material such as polyurethane (PUR) and an outer skin each side of the core. Sandwich panels can thus provide integrated structural and cladding systems. Their strength and light weight means they can span large distances, making them particularly useful for wall and roof systems in commercial or industrial buildings; their use is less common in domestic buildings. Sandwich panels are usually flat and elongate in form, although curved sandwich panels are also available for installation on curved roofs. In use, a side edge of the elongate form is fixed to the side edge of an adjacent panel. For this reason the side edges of the panels are usually designed with complementary profiles to fix together, often employing screw fixings.

As used herein, the term "sandwich panel" means a structure comprising three layers; a core of low-density insulating material and an outer skin each side of the core.

SUMMARY OF THE INVENTION

In a first broad aspect, the present invention provides a sandwich panel comprising metal joists within its outer skin.

In an embodiment, the sandwich panel comprises a thermoplastic skin, preferably HDPE, and an insulating core comprising a foamed material, preferably a polyurethane foam.

In an embodiment, the metal joists are steel joists with a tophat profile.

In an embodiment, a surface of the sandwich panel has a ribbed profile to accommodate the metal joists.

In an embodiment, the metal joists are joined to one another by a cross member fixed between the metal joists, the cross member preferably being a 100 mm steel tophat joist rivet fixed to the joists at 600 mm centres.

In an embodiment, the profile of one side edge is complementary to the profile of the other side edge, such that two adjacent modules can be joined together without fixings, preferably wherein one side edge comprises a lip and the other side edge comprises a complementary crest.

In a second broad aspect, the present invention provides a building module which is a sandwich panel comprising a first region which provides part of the roof structure of a building, a second region which provides part of the wall structure of the building, and a third region which provides part of the floor structure of the building.

In an embodiment, the first and third regions of the sandwich panel are a sandwich panel according to the first aspect.

In an embodiment, the first and third regions are substantially planar and the second region is curved in substantially a semicircle, such that the building module is generally U-shaped.

In an embodiment, the building module has a slot extending from the end of the third region towards the second region to accommodate a metal support, and a hole at the juncture of the second and third regions to receive a metal support.

In a third broad aspect, the present invention provides a method for constructing a sandwich panel, comprising:

a. Forming a skin of the sandwich panel from a thermoplastic in a rotary oven and allowing the thermoplastic to set/cure;
b. Once the skin is set/cured, demoulding the skin and removing at least one end of the panel;
c. inserting metal joists into the panel;
d. Filling the panel with a foamed material and allowing the foamed material to harden;
e. Once the foamed material is hardened, cutting the excess foamed material flush with the cut panel end(s).

In an embodiment, the metal joists are joined to one another by a cross member fixed between the metal joists the cross member preferably being a 100 mm steel tophat joist rivet fixed to the joists at 600 mm centres.

In an embodiment, the sandwich panel comprises first and third regions which are substantially planar and a second region curved in substantially a semicircle, such that the building module is generally U-shaped, and wherein in step b) both ends of the panel are removed to insert steel joists.

In an embodiment, in step d) the U-shaped panel is stood vertically and the foamed material is poured in from the top of the U in a controlled manner to fill the entire cavity of sandwich panel without gaps.

In an embodiment, after step (e) the panel is capped by using a custom heating plate to melt the end of the panel and affixing a thermoplastic end plate, optionally the thermoplastic end plate is the end plate which was removed in step b).

In an embodiment, the foamed material is a polyurethane foam.

In a fourth broad aspect, the present invention provides a method for constructing a sandwich panel, comprising:

a. Extruding a skin of the sandwich panel from a thermoplastic in an extrusion die;
b. Optionally, heating the extrusion and bending the extrusion around a form;
c. allowing the thermoplastic to set/cure;
d. inserting metal joists into the panel;
e. Filling the panel with a foamed material and allowing the foamed material to harden;
f. Once the foamed material is hardened, cutting the excess foamed material flush with the panel end(s).

In an embodiment, the metal joists are joined to one another by a cross member fixed between the metal joists, the cross member preferably being a 100 mm steel tophat joist rivet fixed to the joists at 600 mm centres.

In an embodiment, the sandwich panel comprises first and third regions are substantially planar and a second region curved in substantially a semicircle, such that the building module is generally U-shaped.

In an embodiment, in step d) the U-shaped panel is stood vertically and the foamed material is poured in from the top of the U in a controlled manner to fill the entire cavity of sandwich panel without gaps.

In an embodiment, after step (f) the panel is capped with a thermoplastic end plate using a heat welding process.

In a fifth broad aspect, the present invention provides a method for constructing a building from a plurality of modules according to the second aspect, wherein one side edge of said modules comprises a lip and the other side edge of said modules comprises a complementary crest, the method comprising:

a. Fixing a first module in place with respect to the ground;
b. Aligning a lip of the second module with a complementary crest of the first module, and sliding the second module onto the first module;
c. Optionally, fixing the second module in place with respect to the ground;
d. Aligning a lip of the third module with a complementary crest of the second module, and sliding the third module onto the second module;
e. Repeating steps (c) and (d) until the plurality of modules are installed;
f. Fixing the last module in place with respect to the ground.

In an embodiment, every second module is fixed with respect to the ground.

In an embodiment, the building module comprises substantially planar first and third regions, and the second region is curved in substantially a semicircle, such that the building module is generally U-shaped, and the building module has a slot extending from the end of the third region towards the second region to accommodate a metal support, and a hole at the juncture of the second and third regions to receive a metal support, and the method for fixing the modules to the ground comprises inserting screw piles into the ground at positions which will correspond to the end of the slot of each module which is to be fixed to the ground, to form a first row of screw piles; and inserting screw piles into the ground at positions which will correspond to the hole of each module which is to be fixed to the ground, to form a second row of screw piles.

In an embodiment, the method further comprises fixing a bearer beam to each screw pile in the first row, and fixing another bearer beam to each screw pile in the second row.

In an embodiment, the method further comprises installing a post to each screw pile in the first row, and fixing a beam to the top of the posts in the first row, prior to step (a).

In an embodiment, the method further comprises installing a post to each screw pile in the second row, and fixing a beam to the top of the posts in the first row, after step (f).

DETAILED DESCRIPTION

Preferred embodiments of the invention will now be described with reference to the drawings.

Sandwich Panel

Figure 1:
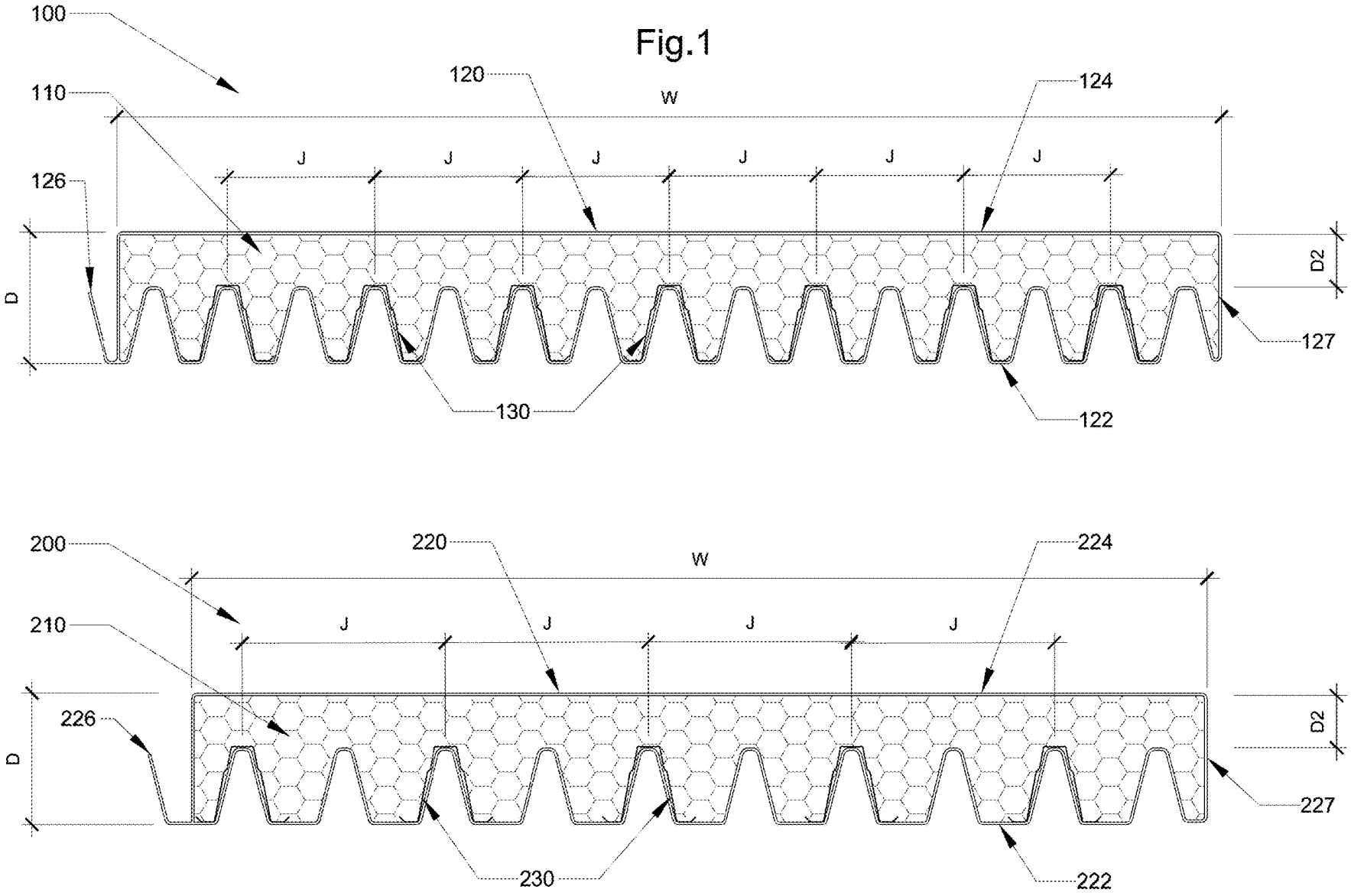
FIG. 1 shows cross section views of sandwich panels according to two preferred embodiments of the invention.

FIG. 1 shows a cross section view of sandwich panels 100 and 200. Sandwich panels 100, 200 have a width W of 2175 and 2000 mm respectively, although it will be understood by persons skilled in the art that other widths can be chosen. The depth D of sandwich panels 100, 200 is shown in FIG. 1, and in this example is on the order of 260 mm. While the length L of sandwich panels 100, 200 is not shown in the cross section drawings of FIG. 1, it will be understood by persons skilled in the art that sandwich panels usually function as a simply supported beam and sometimes as a cantilever beam, and that known principles of beam design can be applied to determine the required depth D of the sandwich panel with reference to a given length L, and vice versa.

The sandwich panel has a core 110, 210, and a thermoplastic skin 120, 220. The lightweight core comprises a foamed material which provides rigidity to the panel. This can be for example a polyurethane foam. A preferred material for the thermoplastic skin is polyethylene, for example high-density polyethylene (HDPE) or linear low-density polyethylene (LLDPE). Thermoplastics have a number of advantages, including that they can easily be moulded into simple or complex shapes, and can be heat welded together. The thickness of the thermoplastic skin 120, 220 in this example is about 5 mm. The thermoplastic skin can be formed in a number of ways, including but not limited rotational moulding, extrusion, and vacuum forming, as is known to persons skilled in the art.

In sandwich panels known in the art, the side edges of the panels are usually designed with complementary profiles to fix together, often employing screw fixings. The sandwich panel of the invention comprises a lip 126/226 which fits over a crest 127/227 of an adjacent sandwich panel.

Sandwich panels 100, 200 comprise steel joists 130, 230. In these examples, steel joists 130, 230 have a profile known as MS Tophat, generally an inverted V-shape with a flat top and protruding flanges on the bottom which can receive fixings (FIG. 1). Suitable steel joists are available from commercial suppliers including Metalcraft Roofing and Steel and Tube Holdings Ltd. An advantage of using a commercial steel joist is that span tables are already available.

One side of the thermoplastic skin 120, 220 has a ribbed profile 122, 222 to accommodate steel joists 130, 230. The other side of the thermoplastic skin has a flat profile 124, 224. Steel joists in sandwich panels 100, 200 have a spacing J of 290 mm centres and 400 mm centres respectively, although the person skilled in the art will appreciate that other spacings are possible. In a preferred embodiment, the steel joists have a cross member rivet-fixed above the joists at 600 mm centres (not shown in FIG. 1). This ensures that the steel joists sit hard into the troughs in the positions shown in FIG. 1. The cross member can be for example a 100 mm steel tophat joist.

Ribbed profile 122, 222 can be described as a deep ribbed profile, where the depth of the ribs is at least half of the depth D of the panel (i.e. D2≤0.5 D). In the embodiments shown, D2 is 103 mm and D is 260 mm.

While inserts 130, 230 are formed from steel, it is contemplated that aluminium joists could also be used. The high strength-to-weight ratio of steel and aluminium makes these materials particularly suitable to form the joists. The person skilled in the art will understand that the joists need not have MS Tophat profiles, but can be any shape which allows them to function as a beam, including for example open web steel joists and rectangular hollow sections. Similarly, there is no need to provide a ribbed profile in the thermoplastic skin in order to accommodate the steel joists. The ribbed profile matching the profile of the joists 130, 230 provides advantages in forming the sandwich panel or building module of the invention, as described below.

Once formed, the sandwich panel of the invention is encapsulated by the thermoplastic skin, which provides weathertightness and durability to the panel. In conjunction with the foamed material, the metal/steel joists provide the thermoplastic-skin panel with greater rigidity, enabling the panel to span greater lengths between supports.

Building Module

Figure 2A:
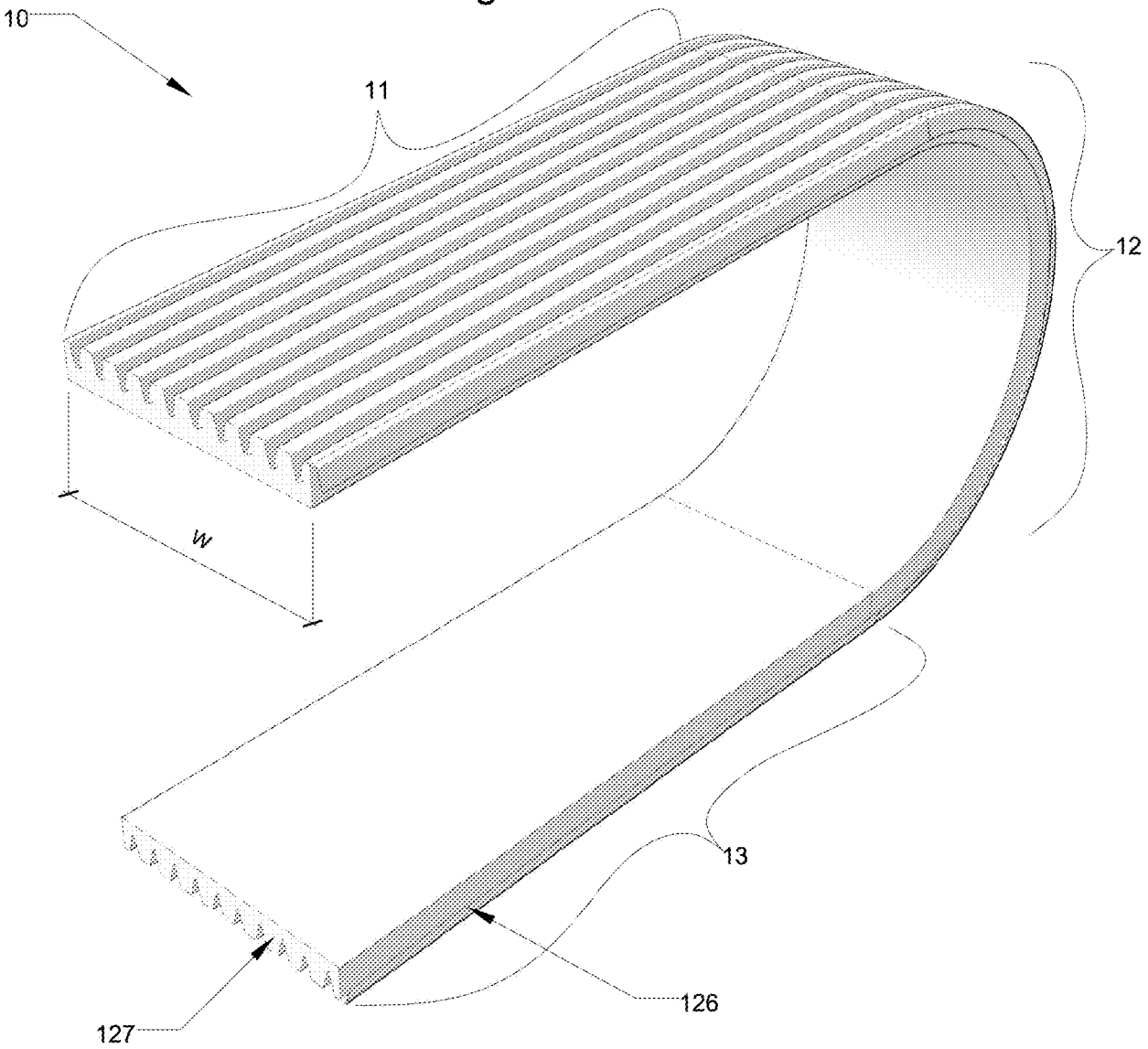
FIG. 2A shows a perspective view of a building module according to a preferred embodiment of the invention.

With reference to FIG. 2A, a Building module 10 which is a sandwich panel is shown. Building module 10 comprises a first region 11 which provides part of the roof structure of a building, a second region 12 which provides part of the wall structure of the building, and a third region 13 which provides part of the floor structure of the building.

It is generally expected that the floor region of the building module will be flat for functional reasons. While the preferred embodiment advantageously has a roof region pitched at 3 degrees to allow for rain runoff and a curved wall region, as discussed further herein, other arrangements are contemplated.

Regions 11 and 13 possess the structure of a sandwich panel 200, comprising steel joists and a foamed material as shown in FIG. 1, ribbed profile for the outer skin, flat profile for the inner skin, and lip 226 (FIG. 2) which fits over crest 227 of an adjacent building module. Region 12 comprises a thermoplastic skin having a cross section corresponding with regions 11/13, but filled with foamed material only. Curved wall region 12 is non-loadbearing and therefore does not have steel joists.

Figure 2B:
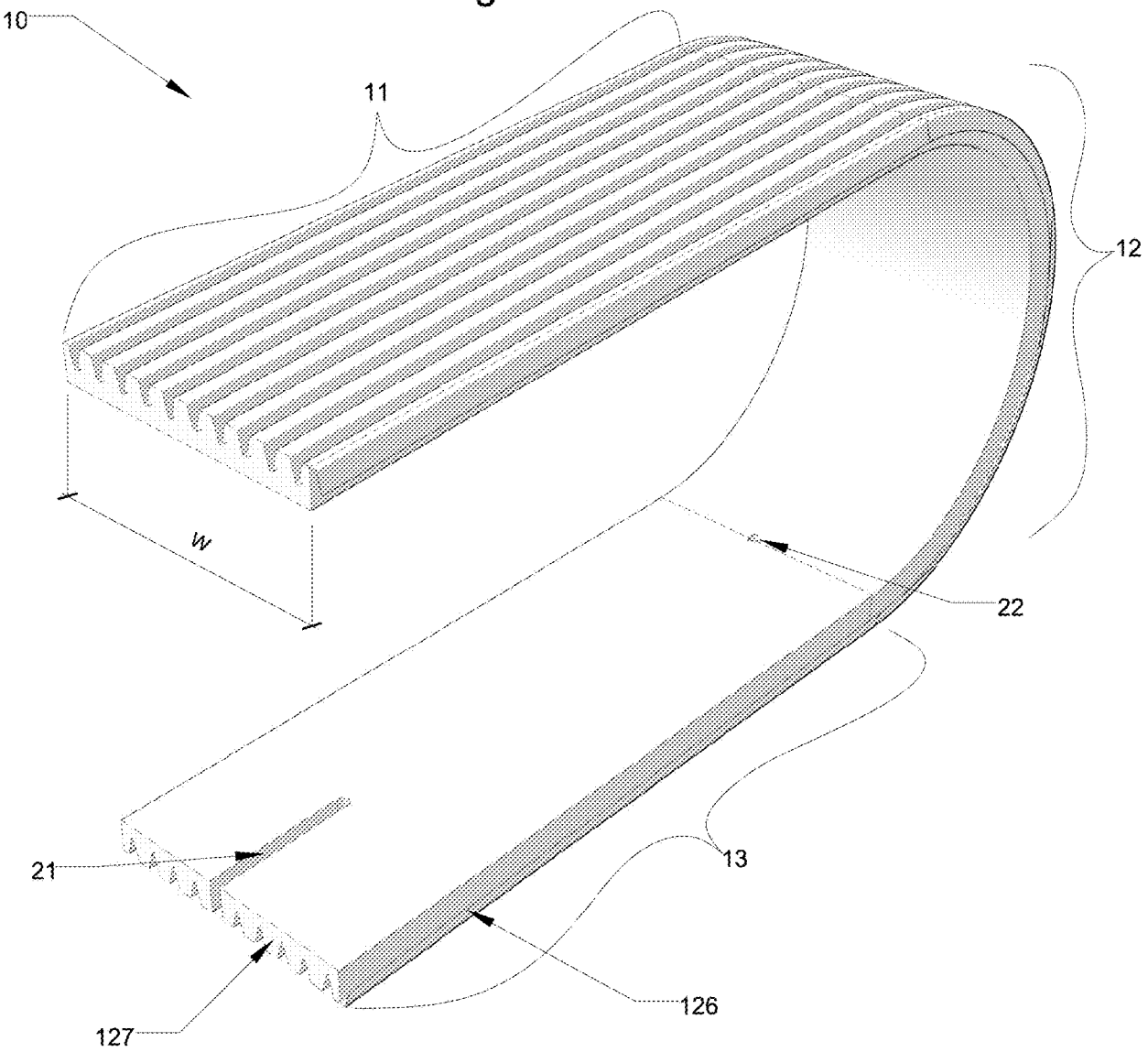
FIG. 2B shows a perspective view of a building module according to another preferred embodiment of the invention.

FIG. 2B shows another building module 20, generally corresponding to building module 10 and comprising first region 11, a second region 12, and third region 13. Building module 20 further comprises slot 21 in region 13, and hole 22 at the junction of regions 12 and 13. The purpose of slot 21 and hole 22 is described below with reference to a preferred way of constructing a building. The steel joists inside each module 20 run parallel with, and flank the slot and hole in each panel. Where interrupted by slot 21, the cross members inside each module will not cross the entire panel.

In the embodiments shown, building modules 10 and 20 have a width W of 2000 mm, although it will be appreciated that other widths can be used.

A number of building modules can be fitted together to provide the floor, wall and roof structure, cladding and insulation of a building of desired length L, being a multiple of the building module width W. A method for constructing a building from building modules 20 is described in detail below.

Method for Forming Sandwich Panel and Building Module

The thermoplastic skin of sandwich panel 100, 200 or building module 10 or 20 can be formed by rotational moulding. This involves forming a skin of the sandwich panel from a thermoplastic in a rotary oven. This results in a completely enclosed hollow skin 120, 220. Rotational moulding ovens are available to fabricate larger items such as storage containers, water tanks and playground equipment. The building module of the invention can be formed in a single piece in a large rotary oven. In the preferred embodiment, the length of building module 10 is on the order of 7 metres, and height on the order of 3 metres. A suitable oven is available at, for example, New Zealand company Galloway International.

Once the skin is set/cured, it can be demoulded. To insert the steel joists into the sandwich panel, one end of the panel is sliced off, the joists can then be slid into place. In the case of a sandwich panel which is a building module 10, the ends of roof region 11 and floor region 13 of the building module are sliced off, the joists can then be slid into place in regions 11 and 13. As mentioned above, in the preferred embodiment, the steel joists are fixed to one another using a cross member, which can be for example a 100 mm steel tophat joist cross member rivet fixed above the joists at a regular spacing, e.g. at 600 mm centres, ensuring that the steel joists sit hard into the troughs.

Once the steel joists are inserted, the panel is filled with a foamed material, in the preferred embodiment a polyurethane foam, ensuring that the entire cavity of the sandwich panel is filled. For the U-shaped building module of the invention, this may be achieved by orienting the panel with regions 11 and 13 pointing upwards and then pouring or injecting the foamed material. Once the foamed material has hardened, the excess material is cut flush with the cut panel end. The end of the panel can then be sealed by heat welding, either using the previously removed end of the panel, or using a custom-made capping, that is then heat-sealed using a custom heating plate to melt the cut end and reseal.

Another way to form the thermoplastic skin is by extrusion. Either the entire skin 120, 220 can be extruded through a die to provide the desired profile of the skin, or separate parts of the skin can be formed by extrusion, for example ribbed side 222 and flat side 224, which can then be welded together. The joists can then be inserted and the ends sealed as in the rotational moulding process. To form building module 10 or 20, the extrusion must be bent or wrapped around a form while in a plastic state.

It will be appreciated by the person skilled in the art that the sandwich panel 100, 200 can be used to form a roof, floor or wall. While the ribbed profile forms the exterior of building module 10 or 20, a planar sandwich panel having the cross section shown in FIG. 1 can be used with the ribbed profile facing either the interior or the exterior of a building.

Method for Constructing a Building Using the Building Module

The person skilled in the art will appreciate that the building modules of the invention can be coupled to one another and fixed to the ground in a number of ways to construct a building. One preferred method is described as follows.

In the preferred embodiment, a screw pile system is used. Screw piles formed from steel are available from, for example, Katana Foundations (NZ). Screw piles have advantages in that they are easy to position and quick to install. They also require no concrete placing and are suitable for deep to soft soil conditions found throughout New Zealand. They can be removed, allowing for the proposed building to be relocated or recycled at end of life. In the method of the example, screw piles are installed in the ground in a grid arrangement, and will each support a steel post P. Screw pile extensions can be coupled to the top of a screw pile above ground. As used herein, the term "screw pile" refers to a screw pile either with or without a screw pile extension.

The method of the example uses building modules 20, which slide onto each other as described further below. Slots 21 and holes 22 are useful in the construction method, but once the building structural system has been erected, all slots 21, and all unused holes 22, are filled in with moulded inserts of the appropriate shape to fit slot 21 and hole 22.

Figure 3:
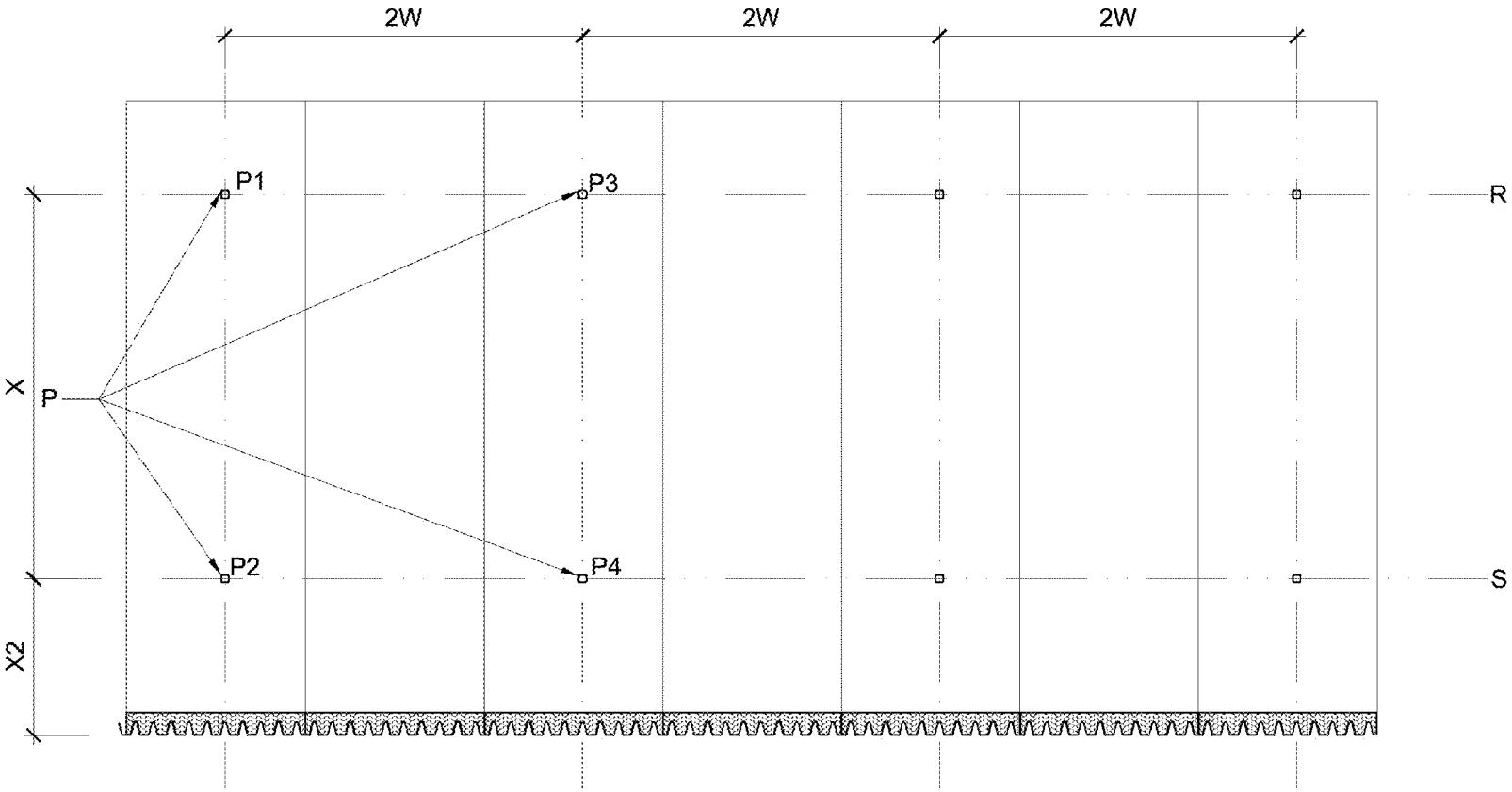
FIG. 3 shows a plan view of a building structural system comprising the building module of FIG. 2B.
Figure 4:
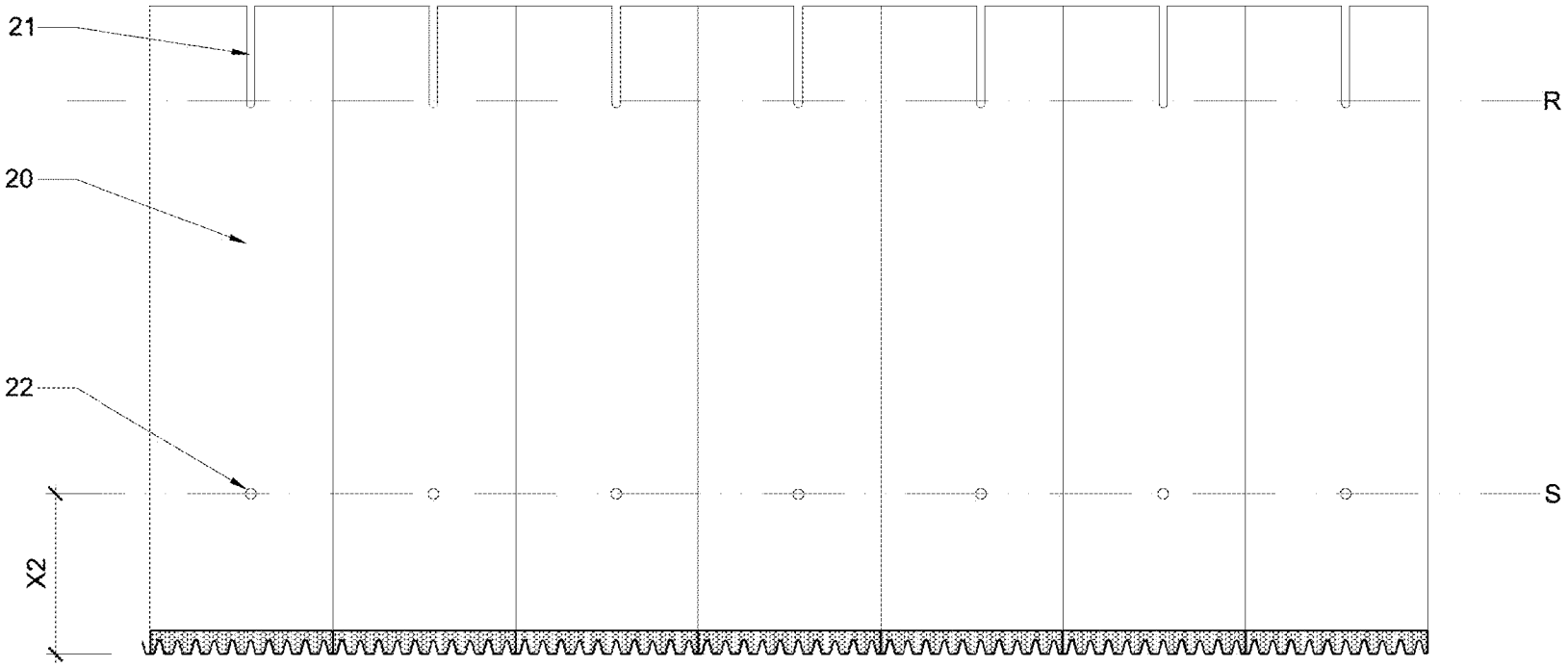
FIG. 4 shows a plan view of a series of building modules according to an embodiment of the invention.

FIGS. 3 and 4 show the grid arrangement of steel posts P at positions P1, P2 etc. Slots 21 and holes 22 (not shown in FIG. 3; shown in FIG. 4) accommodate the steel posts P. Posts P are arranged in two parallel rows R and S (FIG. 4). Posts in rows R and S are at a spacing of 2W, and row R is at a distance X from row S (FIG. 3). In the embodiment shown, X is 4300 mm.

While FIGS. 3 and 4 show a plan view of a building formed from seven building modules 20, it will be appreciated that any number of building modules 20 can be used to form a building in this way.

As shown in FIG. 4, each building module 20 comprises a slot 21 extending from the end of region 13 to the desired position of row R, and a hole 22 at the desired position of row S.

The distance X2 between hole 22 and the periphery of building module 20 should be sufficient to locate hole 22 in floor region 13 rather than curved wall region 12. In the example shown, distance X2 is about 1650 mm and corresponds generally to the radius of curved wall region 12.

Figure 5:
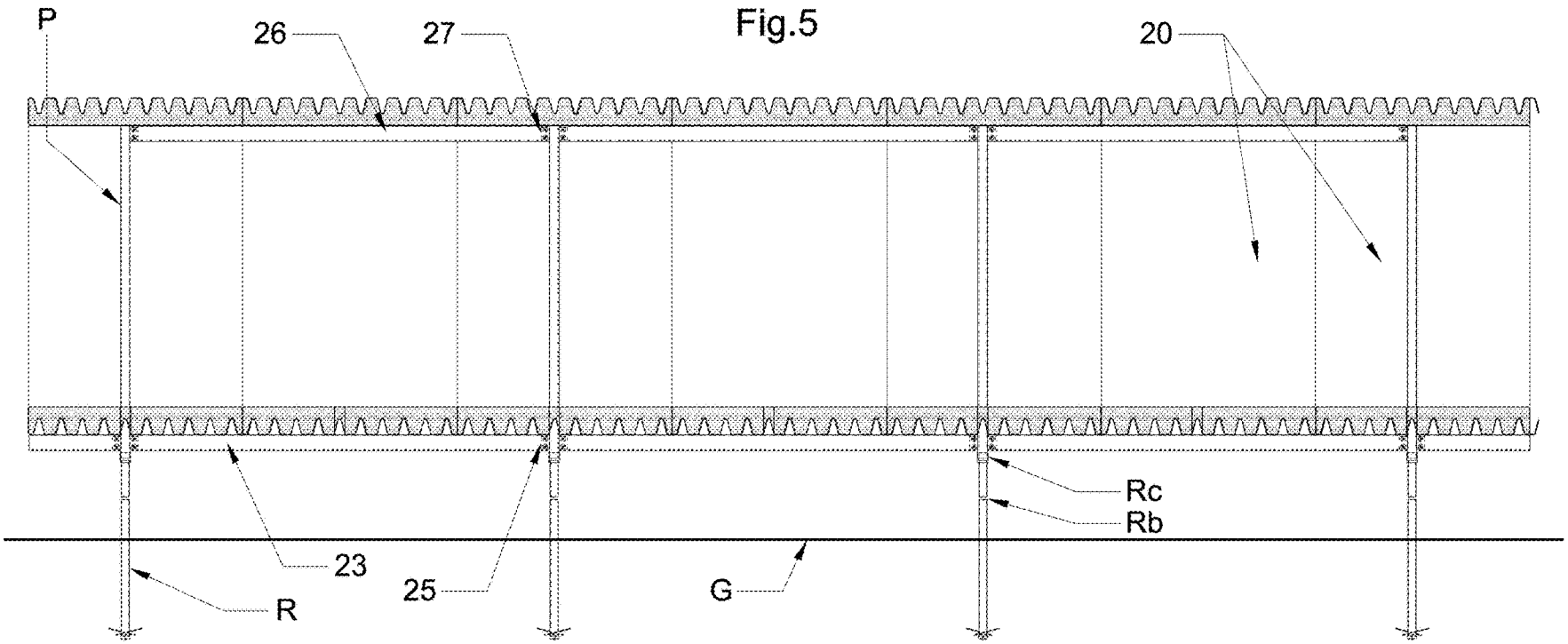
FIG. 5 shows a front elevation of the building structural system shown in FIG. 3.

FIG. 5 shows a schematic front elevation of the structural system for a building according to the invention. In this Figure, a nominal position G is shown for the ground line, and break lines Rb indicate that the proportion of screw piles R above the ground is indeterminate. Adjacent screw piles can be coupled above-ground by cross-bracing as required.

Generally, the top of the shaft of each screw pile can be provided welded to a square drive head. This provides for easy installation of the screw pile and also allows the shaft of the screw pile to be coupled to a post or a pile extension above, by means of a collar, shown as Rc in FIG. 5. The collar advantageously comprises a plate or square nut welded to its inner walls to seat the collar on the square drive head. As is known in the art, the collar can also comprise holes for fixings such as M12 bolts to pierce the pile shaft and/or post.

To construct the building, two rows R and S of screw piles are installed in any order, at a spacing related to the width W of the building modules. In the embodiment shown, the spacing 2W is twice the width W of the building module, and only every second building module will be fixed to a screw pile (FIG. 5). The spacing can also be e.g. equal to the width W of the building module, in which case every building module will be fixed to a screw pile, or another arrangement as will be understood by the person skilled in the art.

The distance between the two rows R, S corresponds to the distance between hole 22 and the end of slot 21 on the building module 20.

Once each row R and S is installed, posts P can be fixed to screw piles in row R, and bearer beams 23 can be fixed to row R and S respectively, at a height to support floor region 11 of the building modules. These steps can be done in any order, provided that no posts P are yet fixed to row S. A bearer beam must be fixed to the screw piles of row S, but it is possible for a bearer beam 23 to be fixed either to the screw piles of row R (i.e. below collar Rc), or to posts P in row R (i.e. above collar Rc, shown in FIG. 5).

Bearer beams 23 can be fixed at row R and S respectively using methods known in the art. The bearer beams can be of any suitable material and profile; a preferred material is hot dipped galvanized steel, preferably of a parallel flange channel (PFC) profile, which will be resistant to corrosion and those at row R can for example be fixed to the posts P using a cleat plate and bolts 25 (shown in FIG. 5).

In this example, each post P is a 89 SHS and is coupled via a collar formed from a 100 SHS to a screw pile having a circular hollow section (CHS) and a square drive head of comparable width to post P. However, posts P can be any desired shape, including for example CHS posts.

Once posts P are installed along row R, a beam 26 is fixed to the top of posts P along row R, using methods known in the art, to support roof region 11 (FIG. 5). In this example the fixing means is via cleat plates and bolts 27. A corresponding frame is to be constructed along row S, but is not yet constructed. Thus, in this example, the entire frame along row R is installed (both the top beam 26 and a bearer beam 23), and a bearer beam 23 is installed to row S, before the modules are fixed to the frame.

Next, slot 21 of a first building module 20 is slid onto a first post P1 in row R, such that hole 22 aligns with screw pile P2 on in row S (FIG. 3). Slot 21 of the first building module can then be plugged with a HDPE moulded insert. Post P2 in row S can then be installed through hole 22 to screw pile P2, either at this stage or after all of the building modules 20 are in place.

The moulded inserts can be provided in the appropriate shape to fit slot 21 and hole 22, and can also be formed by a rotational moulding process. In this example the moulded inserts are also filled with PUR foam for rigidity. They can be heat welded into place once the module is installed on the frame.

A lip of a second module is then aligned with a complementary crest of the first module, and the second building module is then slid onto the first building module. In the embodiment shown, second building module 20 is not installed to a screw pile; it is held to the first module by a friction fit. This means that slot 21 and hole 22 of the second building module 20 will not perform a function, and can be plugged with a HDPE moulded insert. Alternatively, every second building module could be provided without slot 21 and hole 22.

Providing every building module with slot 21 and hole 22 has advantages that only one mould is needed to form the building modules, and provides flexibility during installation.

It will be appreciated that in alternative embodiments, every building module will have a complementary pair of screw piles, and every slot 21 and hole 22 will receive a post P.

In this example, the slot 21 is about 1 m in length. Thus, once installed, the floor region of each module will cantilever 1*m* beyond gridline R (FIG. 4). Optionally, instead of cantilevering the floor regions in this way, an additional steel beam could be placed within each slot 21 to bear on a steel end beam underneath the end of region 13 (not shown). Advantageously, a balustrade could be fixed to such an additional steel end beam.

As stated above, once each building module is installed on the frame along row R, posts P2, P4 etc. can then be installed to screw pile P2, P4 etc. via holes 22. When all posts in row S are in place, a second beam (not shown) can then be fixed to the top of the second row of posts P2, P4 etc. using methods known in the art, to provide a second frame along row S and support the roof region 11.

Dimensions of the posts P and beams can be calculated by methods known in the art, with reference to the required span for beams and the material used, and the load to be borne by beams/posts. The building modules of the invention are strong and lightweight. For an unloaded building module 20, a post of 89 mm width is expected to be sufficient. This does not take account of snow loads; it is also envisaged that the invention will allow for buildings having green roofs, which increase the load on the structural frame. Calculation of the required increase to the dimensions of posts P and roof beams in such situations can be made using known methods. The width of hole 22 and slot 21 are governed by the width of posts P; for example, hole 22 has a diameter of 120 mm to accommodate a steel post of 89 mm width.

Roof region 11 and floor region 13 can be fixed to the respective beams by fixing screws into the steel joists within the panels.

While FIGS. 3 and 4 and the associated text describe a preferred method for fixing the building modules to the ground, it will be appreciated that the general approach of providing holes in the floor region of the building module can be adapted to accommodate any foundation system.

Finished Building

Figure 6:
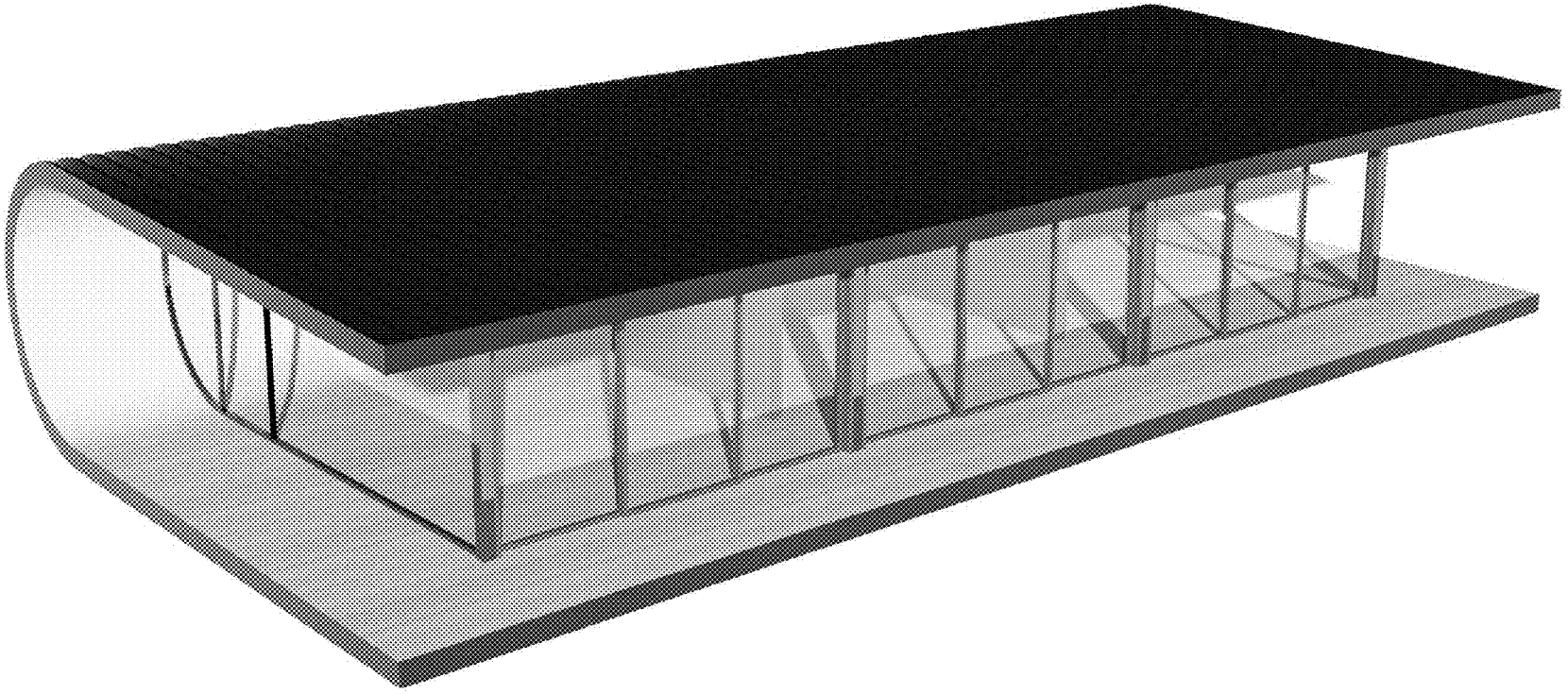
FIG. 6 shows a perspective view of a building constructed from the building module of FIG. 2A or 2B.
Figure 7:
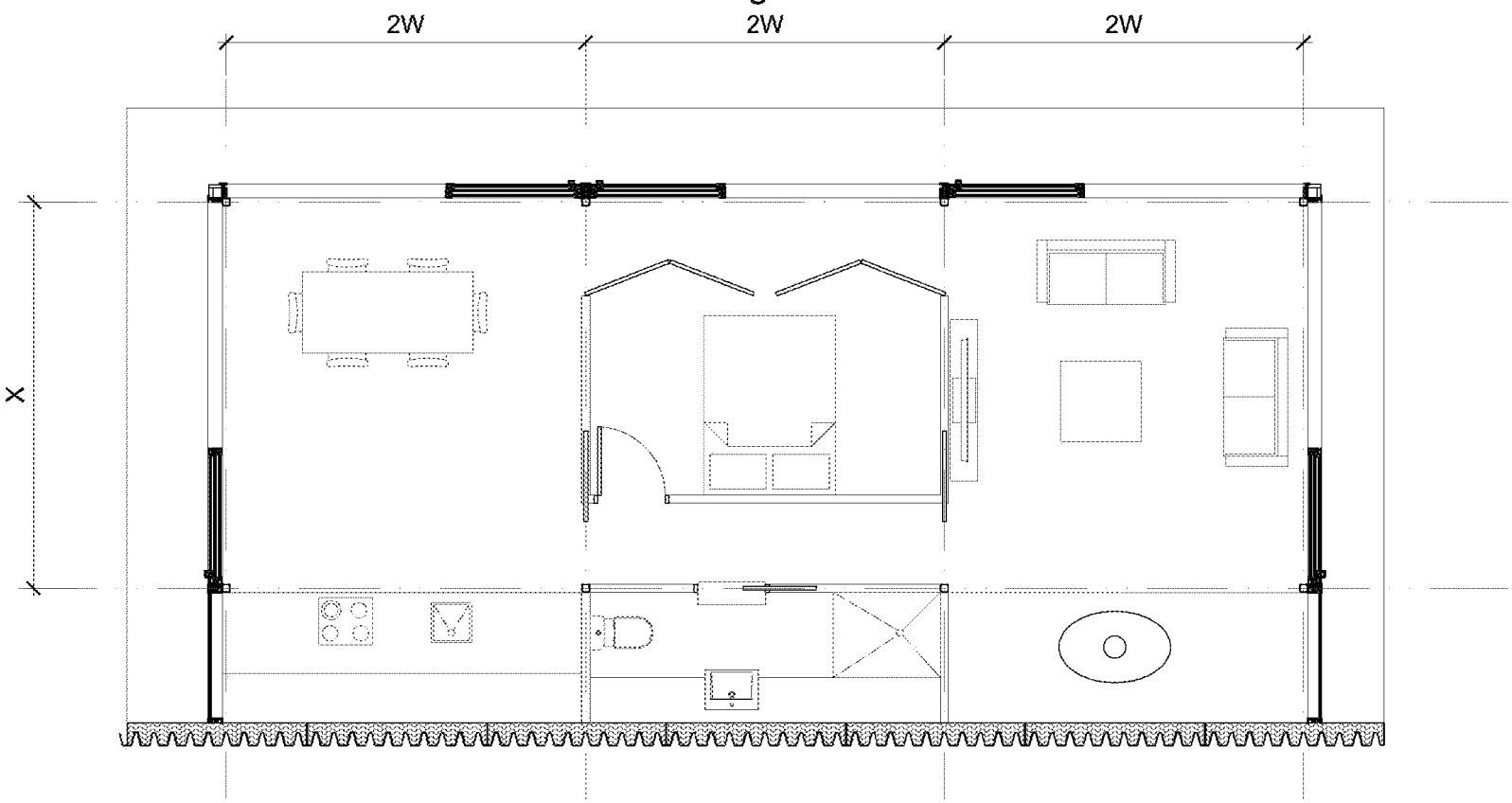
FIG. 7 shows an exemplary plan view of a building as shown in FIG. 3.

After forming the shell of a building by the method described above, the open sides of the building shell may be provided with aluminium joinery, for example double glazed sliding doors and windows, or with another partition wall system. A perspective view of such a building is shown in FIG. 6. Joinery can be fixed to the regions 11, 13 using bolting and/or heat welding techniques. Partition walls can be constructed to the interior of the building using similar bolting and/or heat welding techniques. An exemplary single-bedroom floor plan showing partition walls is shown in FIG. 7; it will be appreciated by the person skilled in the art that many variations are possible.

The surface of the thermoplastic, HDPE in the embodiment shown, is durable and does not need painting or other finishing, and as discussed above, can accept a green roof system if desired. The inner surface of the thermoplastic provides a floor surface and exterior deck. This can provide the finished floor surface, or alternatively a finished floor surface can be provided on top of the thermoplastic using another floor system.

It is to be understood that, if any prior art publication is referred to herein, such reference does not constitute an admission that the publication forms a part of the common general knowledge in the art, in the United States or any other country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated feature but not to preclude the presence or addition of further features in various embodiments of the invention.

The invention claimed is:

1. A building module which is a sandwich panel comprising:

an inner core comprising a foamed material; and an outer skin comprising a thermoplastic which completely encloses the inner core;

a first region which provides part of the roof structure of a building, a second region which provides part of the wall structure of the building, and a third region which provides part of the floor structure of the building, metal joists within the outer skin of the first region and the third region.

2. The building module according to claim 1, wherein:

the outer skin comprises a body and at least one end plate, the body completely encloses the length of the inner core, and the at least one end plate cooperates with the body to completely enclose the inner core.

3. The building module according to claim 1, wherein the metal joists are steel joists with a tophat profile.

4. The building module according to claim 1, wherein a surface of the sandwich panel has a ribbed profile to accommodate the metal joists.

5. A sandwich panel according to claim 1, wherein a profile of a first side edge of the sandwich panel is complementary to a profile of a second side edge, such that the building module can be joined with an adjacent building module without fixings.

6. A building module according to claim 5, wherein the first side edge comprises a lip and the second side edge comprises a complementary crest.

7. A building module according to claim 1, wherein the first and third regions are substantially planar and the second region is curved in substantially a semicircle, such that the building module is generally U-shaped.

8. The building module according to claim 1, wherein the foamed material is a polyethylene foam.

9. The building module according to claim 1, wherein the thermoplastic is HDPE.

10. A building module which is a sandwich panel comprising a first region which provides part of the roof structure of a building, a second region which provides part of the wall structure of the building, and a third region which provides part of the floor structure of the building, wherein the first and third regions are a sandwich panel comprising metal joists within a singular outer skin, wherein the building module has a slot extending from an end of the third region towards the second region to accommodate a first metal support, and a hole at a juncture of the second and third regions to receive a second metal support.

* * * * *